US011089857B1

(12) United States Patent
Anderson-Bisson

(10) Patent No.: US 11,089,857 B1
(45) Date of Patent: Aug. 17, 2021

(54) METHODS FOR APPLYING A COLOR-ALTERING MATERIAL TO HAIR

(71) Applicant: Lisa Anderson-Bisson, Dracut, MA (US)

(72) Inventor: Lisa Anderson-Bisson, Dracut, MA (US)

( * ) Notice: Subject to any disclaimer, the term of this patent is extended or adjusted under 35 U.S.C. 154(b) by 184 days.

(21) Appl. No.: 16/274,657

(22) Filed: Feb. 13, 2019

Related U.S. Application Data

(60) Provisional application No. 62/630,513, filed on Feb. 14, 2018.

(51) Int. Cl.
*A45D 19/02* (2006.01)
*A45D 19/00* (2006.01)
*A45D 24/34* (2006.01)

(52) U.S. Cl.
CPC ..... *A45D 19/02* (2013.01); *A45D 19/0083* (2021.01); *A45D 2200/10* (2013.01)

(58) Field of Classification Search
CPC .... A45D 2019/0041; A45D 2019/0066; A45D 2019/0075; A45D 2019/0083; A45D 2019/0091; A45D 19/0008; A45D 19/02; A45D 19/16; A45D 19/00; A45D 2007/001; A45D 7/04; A45D 7/045; A45D 7/06; A45D 7/065; A45D 97/00; A45D 7/00; A45D 24/24; A45D 24/34; A45D 2024/345; A45D 24/22–28; A45D 19/0083; A45D 19/0075; A45D 19/0066; A45D 19/028; A61Q 5/065
USPC ..... 132/202–211, 902, 320, 212, 221; D28/7, 20; 15/104.93; 401/265, 266, 401/267
See application file for complete search history.

(56) References Cited

U.S. PATENT DOCUMENTS 1,708,346 A * 4/1929 Worrell ..... B29C 73/26 81/15.2
D155,308 S * 9/1949 Morrison ..... A61Q 5/065 D28/7
2,865,383 A * 12/1958 McDougall ..... A45D 19/02 132/213
3,523,630 A * 8/1970 Catapano ..... A45D 19/02 222/568
4,813,439 A * 3/1989 Morgan ..... A45D 19/02 132/112
5,156,172 A * 10/1992 Tancredi ..... A45D 19/0025 132/207

(Continued)

OTHER PUBLICATIONS

Melissa Matthews, Women's Day Guide to At-Home Hair Dyeing, Jun. 29, 2010, Women's Day. (Year: 2010).*

(Continued)

*Primary Examiner* — Ralph A Lewis
*Assistant Examiner* — Sharon E Kennedy
(74) *Attorney, Agent, or Firm* — Burns & Levinson LLP; Janine M. Susan; Marlo Schepper Grolnic

(57) ABSTRACT

Described herein are methods for applying a color-altering material to the roots of the hair which reduce the amount of time needed between color applications. The color-altering material is applied horizontally with respect to the hair, and the natural color of the hair is left intact between the color-altering sessions. The methods of this disclosure incorporate the root growth into the overall color pattern of the hair, allowing a user to wait for a longer period of time in between color applications.

18 Claims, 6 Drawing Sheets

(56) References Cited

U.S. PATENT DOCUMENTS

| | | | | |
|---|---|---|---|---|
| 5,289,833 | A * | 3/1994 | McDonald | A45D 24/26 132/112 |
| 5,349,970 | A * | 9/1994 | Razzouq | A45D 19/0016 132/208 |
| 5,778,902 | A | 7/1998 | Nagy | |
| 5,845,653 | A | 12/1998 | Abercrombie | |
| 5,964,226 | A | 10/1999 | Sobel | |
| 6,013,110 | A | 1/2000 | Gee | |
| 6,684,887 | B2 * | 2/2004 | Alexander | A45D 24/22 132/112 |
| 6,736,145 | B2 * | 5/2004 | Alexander | A45D 24/22 132/112 |
| 7,077,146 | B1 | 7/2006 | Eckerson | |
| 7,328,710 | B2 | 2/2008 | Hall et al. | |
| 7,779,847 | B2 * | 8/2010 | Castagno | A46B 9/005 132/200 |
| 9,539,183 | B2 | 1/2017 | Hong | |
| 2003/0074746 | A1 * | 4/2003 | Fischer | A61Q 5/065 8/405 |
| 2004/0045101 | A1 * | 3/2004 | Miczewski | A61Q 5/10 8/406 |
| 2005/0072442 | A1 | 4/2005 | Licari et al. | |
| 2016/0029766 | A1 * | 2/2016 | Huang | A45D 19/02 132/200 |
| 2016/0309870 | A1 * | 10/2016 | Pao | A46B 9/023 |
| 2016/0374446 | A1 | 12/2016 | Belem de Assis Marinho | |
| 2018/0343998 | A1 * | 12/2018 | Hogan | A45D 19/00 |
| 2019/0090606 | A1 * | 3/2019 | McIvor, Jr. | A46B 5/0008 |
| 2019/0246763 | A1 * | 8/2019 | Smith | A45D 19/02 |

OTHER PUBLICATIONS

"How to Make Coontails in Your Hair," from WikiHow to do Anything. Downloaded from www.wikihow.com on Feb. 21, 2017 (3 pgs).

Jakaitis, E. "The Ponytail Technique: the Secret to a Faster Ombre," from Modern Salon, dated Jan. 16, 2015. Downloaded from www.ModernSalon.com on Feb. 21, 2017 (4 pgs).

"How to Two-Toned Punked® Hair and Punked® Horizontal Stripes" from Punked Neon Hair Dye & Contact Lenses Facebook page, dated Aug. 28, 2014. Downloaded from www.facebook.com on Feb. 21, 2017 (2 pgs).

* cited by examiner

METHODS FOR APPLYING A COLOR-ALTERING MATERIAL TO HAIR

CROSS-REFERENCE TO RELATED APPLICATIONS

This application claims priority to and benefit of U.S. Provisional Application No. 62/630,513, filed Feb. 14, 2018, entitled METHODS FOR APPLYING A COLOR-ALTERING MATERIAL TO HAIR, the contents of which are incorporated herein by reference in their entirety for all purposes.

FIELD

This disclosure relates generally to methods for coloring human hair and, more particularly, to methods for applying a color-altering material to newly-grown hair.

BACKGROUND

Techniques for applying color-altering materials to hair for the purpose of temporarily or permanently changing the color of the hair are well-known in the art. The color of hair can be altered through the use of rinses, sprays, lotions or creams. When darkening hair, the coloring material usually takes the form of a dye; when lightening hair, a bleach and activator combination, along with a toner, is typically utilized. Regardless of the color-altering material that is used, the material is applied in a step-by-step manner, often requiring a waiting period to allow the chemicals in the color-altering material to react and for the material to bond with the hair.

While hair may be bleached or dyed to disguise the effects of aging, it is also commonly used to change the overall color of the hair for cosmetic purposes. In such cases, the bleach or dye is typically applied with a brush in a first application over the entire body of the hair. As the hair grows, however, the original hair color is exposed by the newly-grown hair near the scalp (often termed the "roots" of the hair), sometimes within a matter of days. The bleach or dye must then be subsequently applied to the roots to maintain the overall color effect, typically between 4-8 weeks from the last application. Unfortunately, the necessity of having to continually apply the color-altering material to the roots of the hair puts a burden on the user, both in time and expense. Additionally, when using an at-home coloring product, an amateur user may find it difficult to match the color of the product to the color of the rest of the hair.

Other common methods for coloring hair which do not affect the overall color of the hair are known as "highlighting" and "frosting." These techniques are used to enhance the natural hair color or to give the appearance of dimension and depth to color-treated hair. In both of these methods, thin sections of hair are isolated from the rest of the hair and a bleaching agent is applied with a brush along the length of the hair. However, highlighting or frosting hair can leave the hair looking blotchy, with clumps of lighter hair that do not blend well with the rest of the hair. Furthermore, highlighting or frosting hair does not resolve the problem of darker roots appearing over time.

BRIEF SUMMARY

Described herein are methods for applying a color-altering material to newly-grown or "roots" of the hair which are simple and cost-effective, and which reduce the amount of time needed between color applications. The color-altering material is applied to a thin section of hair (hereinafter referred to as a "slice" to distinguish from sections of larger quantities of hair, commonly known as "sections" in the art) horizontally with respect to the hair, and the natural color of the hair is left intact between the color-altering sessions. Thus, the methods of this disclosure advantageously incorporate the root growth into the overall color pattern of the hair, allowing a user to wait for a longer period of time in between color applications.

Further examples of the methods of this disclosure may include one or more of the following, in any suitable combination.

Examples of the method for applying a color-altering material to hair of this disclosure include: a) selecting a first slice adjacent an origination point on a scalp; b) positioning a distal end of a tool coated in the coloring-altering material on one side of the slice such that a long axis of the tool is perpendicular to a length of the hair; c) folding the slice over the tool; d) removing the tool from beneath the folded-over slice; e) selecting a second slice adjacent the first slice; f) repeating steps b)-d) to apply the coloring-altering material to the second slice; g) allowing the material to react and bond with the hair; and h) removing the material from the hair. Further examples of the method include: i) allowing the hair to grow for a period of time; and j) repeating steps a)-h) to color the hair. In examples, the period of time is about 3 months to about 6 months.

In further examples, the method of this disclosure includes aerating the color-altering material such that a consistency of the color-altering material is similar to whipped cream. In examples, a depth of the first slice is selected based on the length of the hair, which may be between about 1/16 inches and about 1/4 inches. In examples, a depth of the second slice is selected based on the length of the hair, which may be between about 1/16 inches and about 1/4 inches. In examples, the first slice is dry hair. In examples, the method further includes, after step d), using the tool, pressing the first slice towards the scalp to urge the color-altering material through the first slice. In examples, a depth of the first slice is selected to be translucent. In examples, the origination point is one of a natural part of the hair, a crown of a head, an occipital bone, or a nape of a neck. In examples, the material is applied to the first slice from beneath the first slice. In examples, the material comprises a developer and a powder, and a ratio of developer to powder is about 1:1.3 to about 1:1.8. In examples, a proximal end of the tool has a curved surface and the distal end of the tool is cylindrical. In examples, a diameter of the distal end of the tool tapers distally from about 1/2 inches to about 1/4 inches.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The disclosure will be more fully understood by reference to the detailed description, in conjunction with the following figures, wherein.

DETAILED DESCRIPTION

Figure 1:
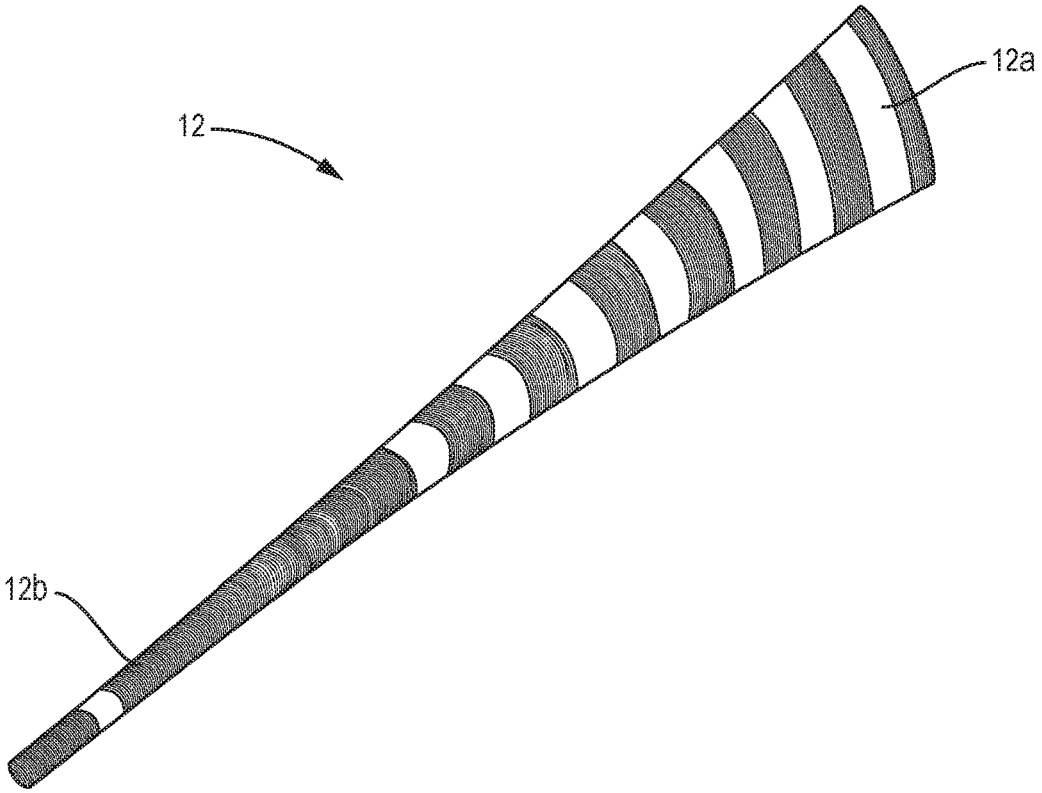
FIG. 1 illustrates an exemplary tool for use with the methods of this disclosure.

In the description that follows, like components have been given the same reference numerals, regardless of whether they are shown in different examples. To illustrate example(s) in a clear and concise manner, the drawings may not necessarily be to scale and certain features may be shown in somewhat schematic form. Features that are described and/or illustrated with respect to one example may be used in the same way or in a similar way in one or more other examples and/or in combination with or instead of the features of the other examples.

As used in the specification and claims, for the purposes of describing and defining the invention, the terms "about" and "substantially" represent the inherent degree of uncertainty that may be attributed to any quantitative comparison, value, measurement, or other representation. The terms "about" and "substantially" are also used herein to represent the degree by which a quantitative representation may vary from a stated reference without resulting in a change in the basic function of the subject matter at issue. "Comprise," "include," and/or plural forms of each are open ended and include the listed parts and can include additional parts that are not listed. "And/or" is open-ended and includes one or more of the listed parts and combinations of the listed parts.

FIG. 1 illustrates an exemplary tool 12 for applying a color-altering material 14 of this disclosure. As shown in FIG. 1, the tool 12 may be elongated and comprise a substantially flat proximal end 12*a* and a cylindrical distal end 12*b*. A diameter of the distal end 12*b* is selected to be smaller than a width of the proximal end 12*a*. The proximal end 12*a* of the tool 12 may have a curved surface and is sized to provide a comfortable grip for a user's hand. The distal end 12*b* of the tool 12 may be substantially cylindrical, enabling even distribution of the material 14 on the hair. A length and a width of the tool 12 may vary, depending upon the application. In examples, a length of the tool 12 may be about 10.5 inches and a diameter of the distal end 12*b* of the tool 12 may taper distally from about ½ inches to about ¼ inches along the length of the tool 12. The tool 12 of this disclosure may be made of any material which is lightweight and mostly rigid while still providing some flexibility to the tool 12. In examples, the tool 12 is comprised of plastic.

Turning now to FIGS. 2-7, examples of the methods for applying a color-altering material of this disclosure are generally designated by the reference numeral 10. To begin the method 10, the coloring-altering material 14 to be used is selected and prepared according to the instructions provided, except as described below. In examples, the material 14 may be any colorant that is acceptable for use on hair. The colorant may be permanent, semi-permanent, demi-permanent, and may also be either natural or synthetic. Examples of synthetic colorants useful with the tool 12 in the method 10 of this disclosure include, but are not limited to, HO, D&C, or FD&C colors, nitro derivatives of aminophenols and phenylenediamines; or para-dyes, such as p-phenylene diamine, p-toluenediamine, p-aminophenyldiamine, p-aminophenol and derivatives thereof. Also, indamines and indophenols, and acid and basic colors, such as acid blues, browns, reds, yellows or oranges, and basic blues, greens, yellows, reds, violets, and brown can be used. An exemplary list of cosmetically acceptable hair colorants can be found in the International Cosmetic Ingredient Dictionary and Handbook, 16th Edition, Cosmetic Toiletry and Fragrance Association, Washington, D.C., 2016, the contents of which are incorporated herein by reference. Naturally occurring colorants (and their active components) which may be used include, but are not limited to, annatto extracts, saffron (crocin), grape color or grape skin extract (malvidin, delphenidin or cyanidin derivatives), beet extract, (betacyanins or betaxanthins) or henna.

In certain cases, particularly when a permanent, lightening effect is desired, the color-altering preparation (i.e., dye precursors) is in the form of a colorless powder. A developer, such as hydrogen peroxide, is mixed with the powdered dye to oxidate the dye and give it its final color. In an example of the method of this disclosure, a higher ratio of powder to developer is used than the recommended ratio of the package directions. For example, the directions may recommend 6 oz. of developer to 7 oz. of powder (a ratio of 1:1.2), whereas an example of the method of this disclosure may use about 6 oz. of developer to about 8-11 oz. of powder (a ratio of about 1:1.3 to about 1:1.8). The higher ratio allows the material 14 to be aerated by mixing it in a container until it has a consistency similar to that of whipped cream.

Figure 2:
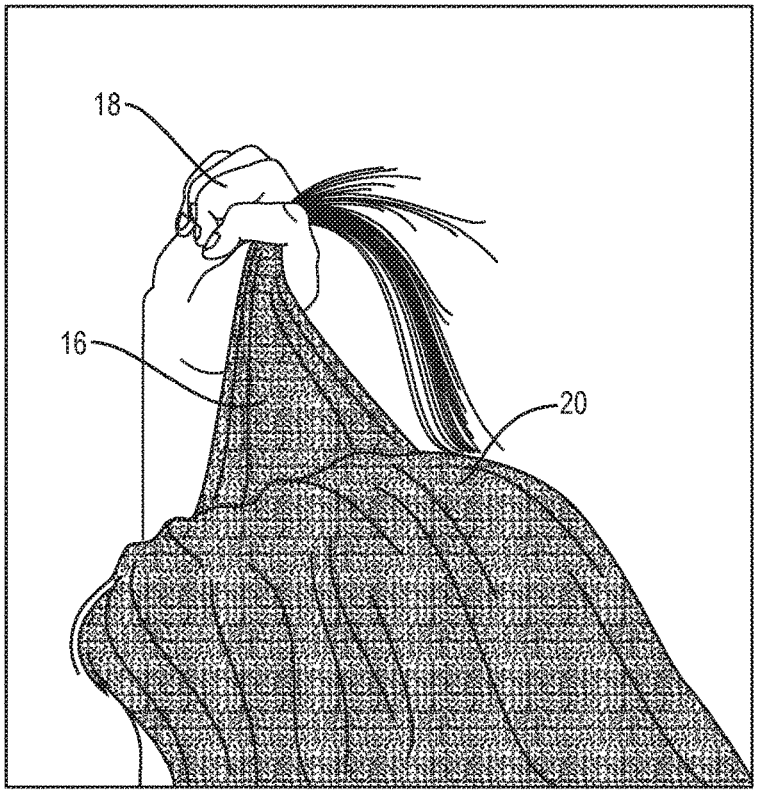
FIGS. 2-7 show the steps of an exemplary method for applying a coloring-altering material to hair.

Turning now to FIG. 2, a first small section of hair 16, which is preferably dry hair, is selected for the first application of the material 14. In examples, the first slice 16 may originate either near the crown of the head or the natural part of the hair, as shown in FIG. 2. In other examples, not shown, the first slice 16 may originate at the occipital bone or the nape of the neck. Where convenient, hair clips or other devices known in the art (not shown) may be used to isolate the portion of hair being colored. In examples, the tool 12 may be used to lift the first slice 16 away from the scalp 20. A selected depth between the first slice 16 and the natural part of the hair may vary depending upon whether the hair is short hair (less than 6 inches long), medium length hair (between about 6 inches and about 12 inches long), or long hair (more than 12 inches long). For example, a depth may be about 1/16 inches for short hair, about ⅛ inches for medium length hair or about ⅛ to about ¼ inches for long hair. Notably, the depth of any slice should be thin enough to allow light through when raised from the scalp 20. Preferably, the first slice 16 is held by a user's hand 18 about four inches from the scalp 20.

Figure 3:
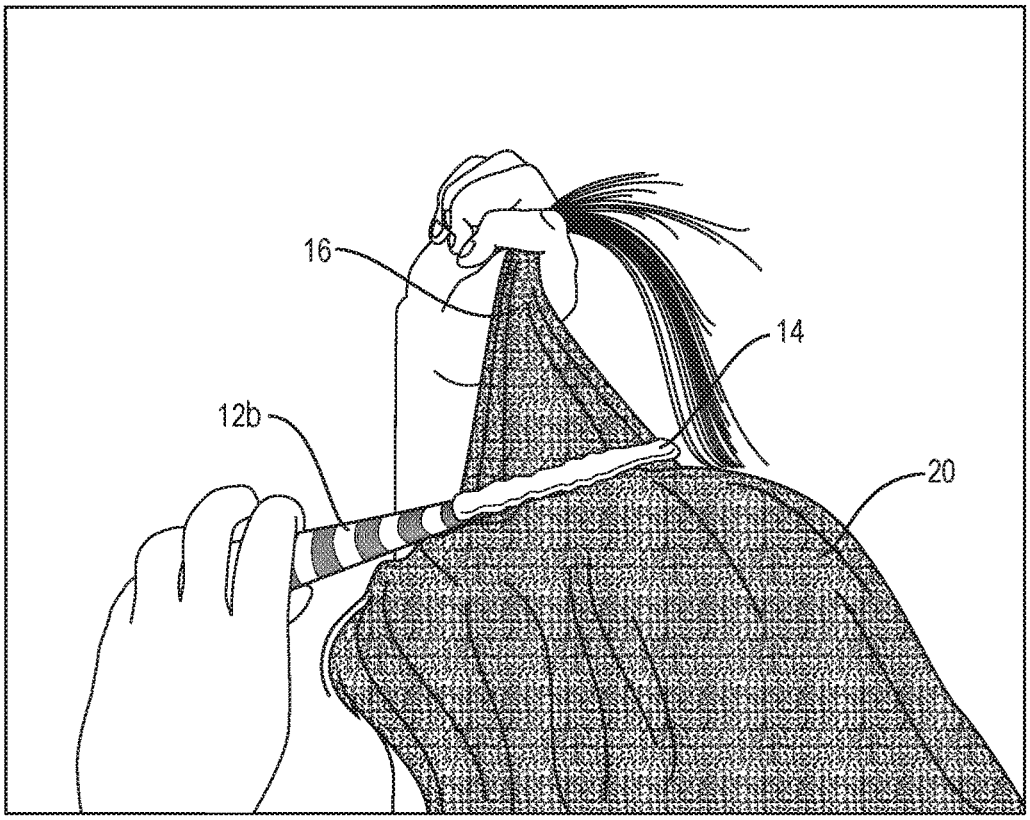
Figure 4:
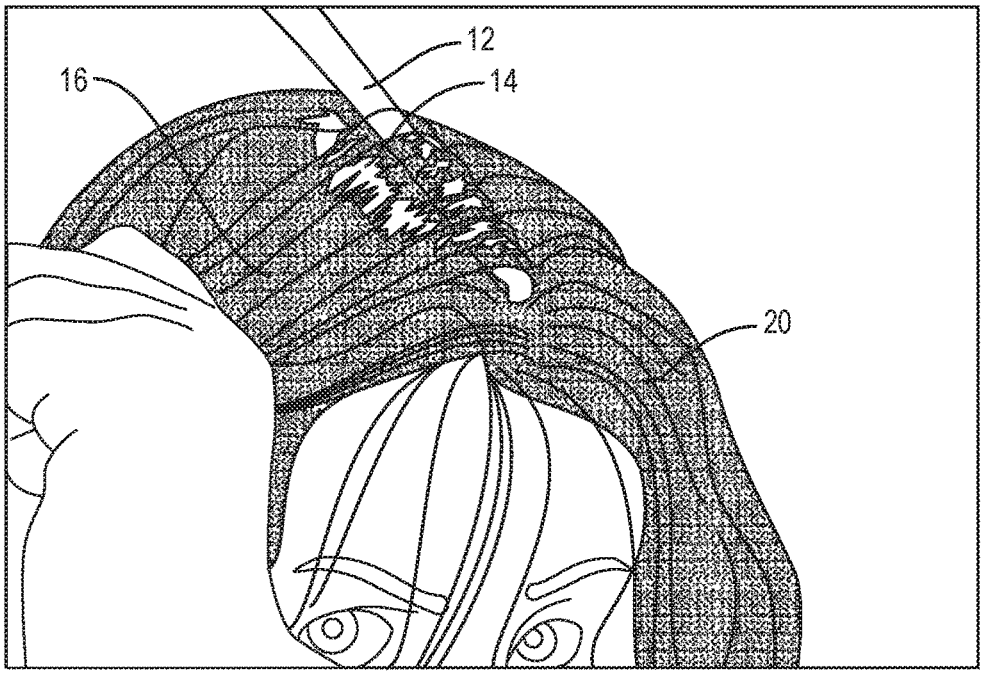
Figure 5:
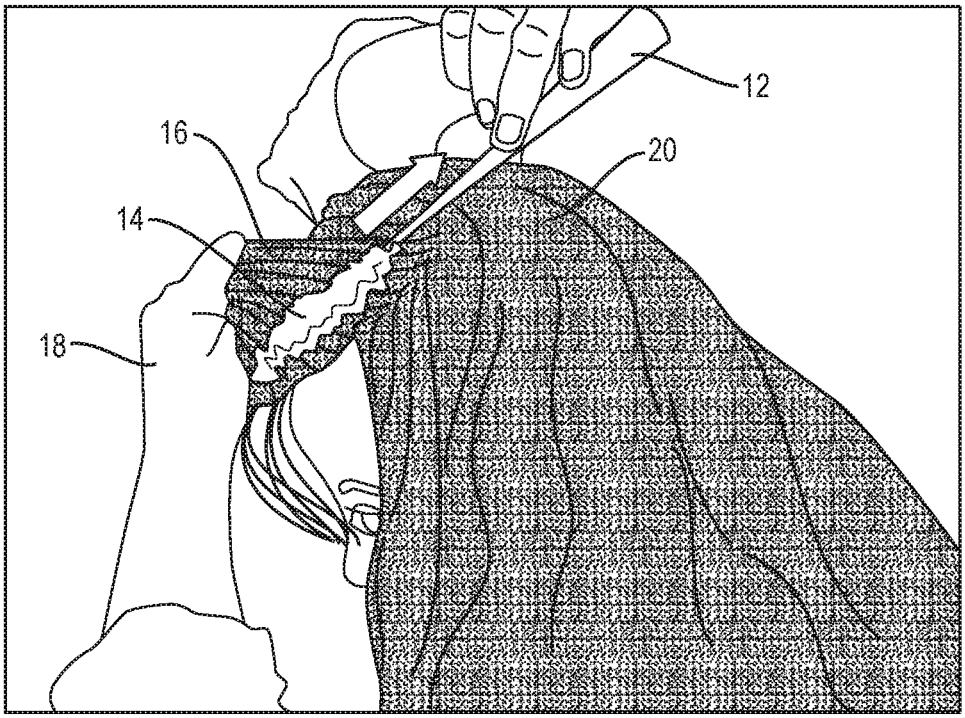

The distal end 12*b* of the tool 12 is then coated with the material 14, for example, by dipping the tool 12 into the container of material 14. The tool 12, along with the coating of material 14, is then laid across the hair horizontally such that a long axis of the tool 12 is perpendicular to a length of the hair, as shown in FIG. 3. In examples, the tool 12 is positioned between about 1/16 inches to about ⅛ inches above the scalp 20 to one side of the first slice 16. Afterwards, the first slice 16 is folded over the tool 12 such that the material 14 is pushed through the first slice 16 (FIG. 4). As shown in FIG. 5, while the hand 18 is still holding onto the first slice 16, the tool 12 is pulled out from beneath the folded-over first slice 16. As such, the material 14 can be said to be applied underneath the first slice 16 rather than on top of the first slice 16, as in a typical application. The tool 12 can then optionally be used to press down on top of the folded-over first slice 16 to further urge the material 14 to penetrate the first slice 16. The folded-over first slice 14 may then be relinquished and allowed to rest in a natural position above the scalp 20. Optionally, the tool 12 can be cleaned of any residue of material 14.

Figure 6:
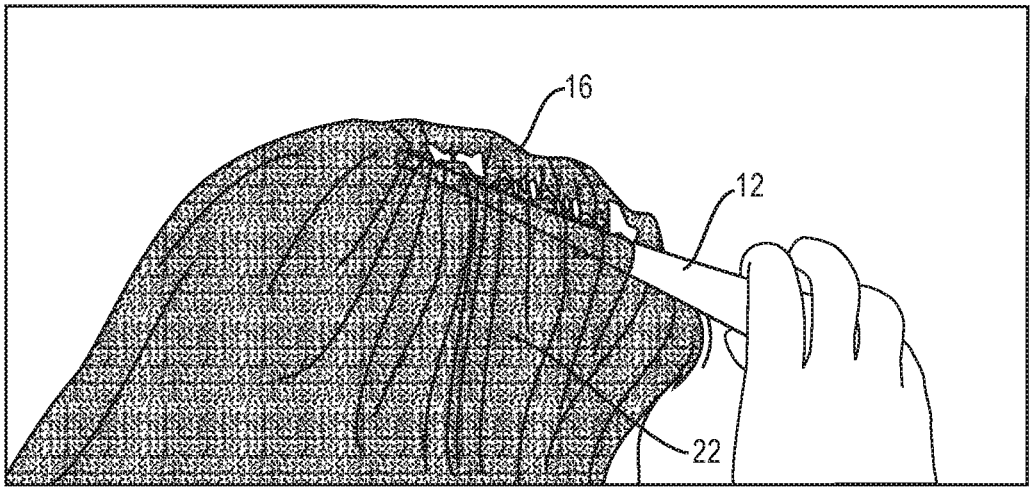
Figure 7:
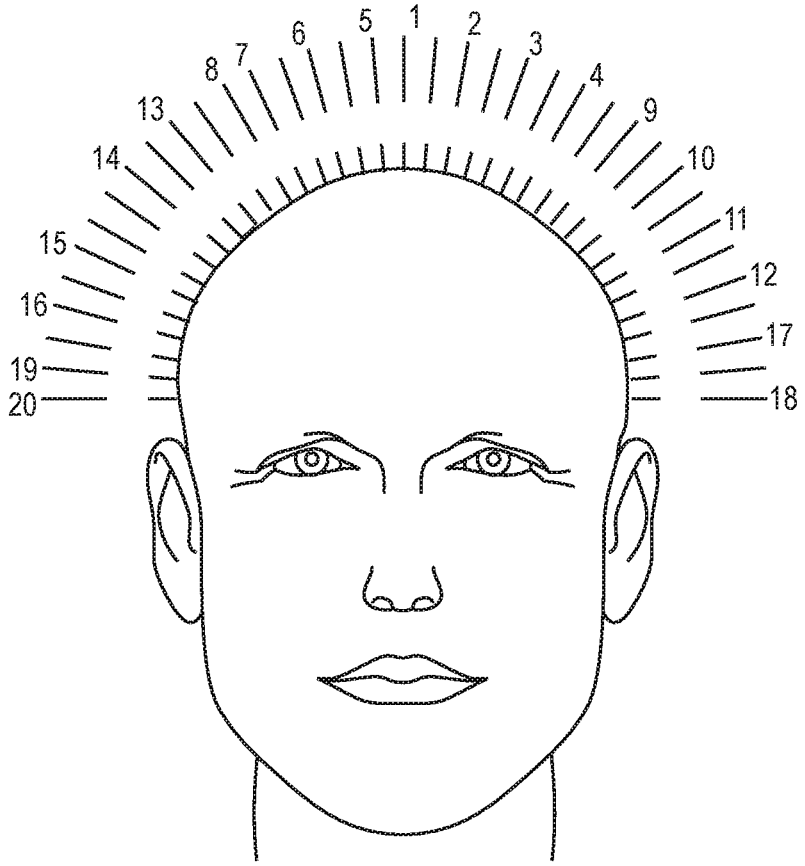

Turning now to FIG. 6, in examples, the tool 12 is then used to lift a second slice 22 from the scalp 20 adjacent the first slice 16. A depth of the second slice 22 is selected to be substantially similar to the depth of the first slice 16. For example, a depth of the second slice 22 may be about ⅛ inches for medium length hair. The steps for applying the material 14 to the second slice 22 are substantially the same steps as described above with regard to FIGS. 3-5. After applying the material 14 to the second slice 22, the second slice is relinquished and allowed to lie naturally over the first slice 16, keeping the first slice 16 and the second slice 22 together as much as possible. The process is then repeated by selecting the hair in slices, alternating from one side of the part to the other. In examples, the process can be repeated following the numbered sequences illustrated in FIG. 7. However, any sequence for applying the coloring-altering material to the hair is contemplated by this disclosure.

Figure 8:
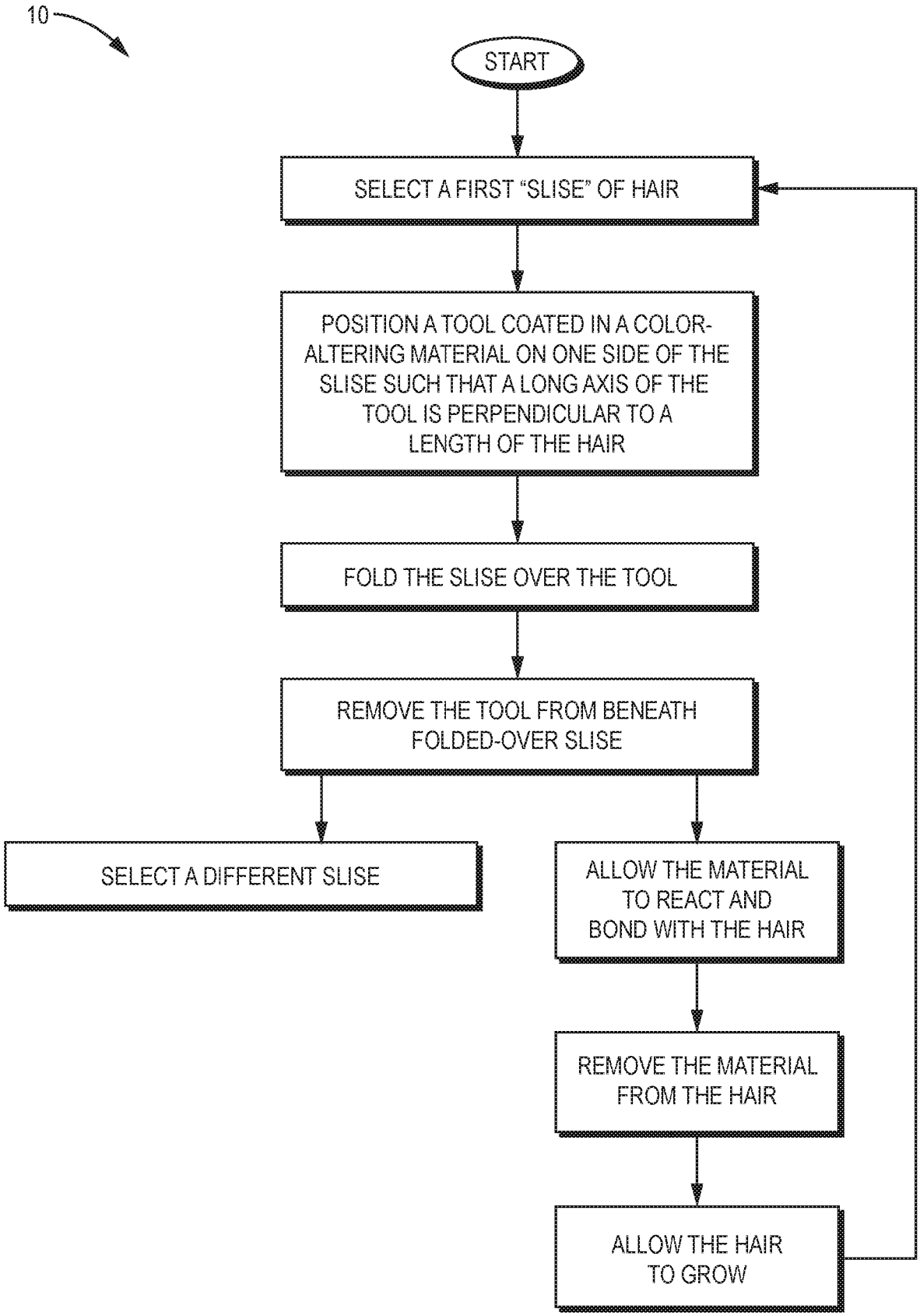
FIG. 8 is a flowchart of the steps of FIGS. 2-7.
Figure 9:
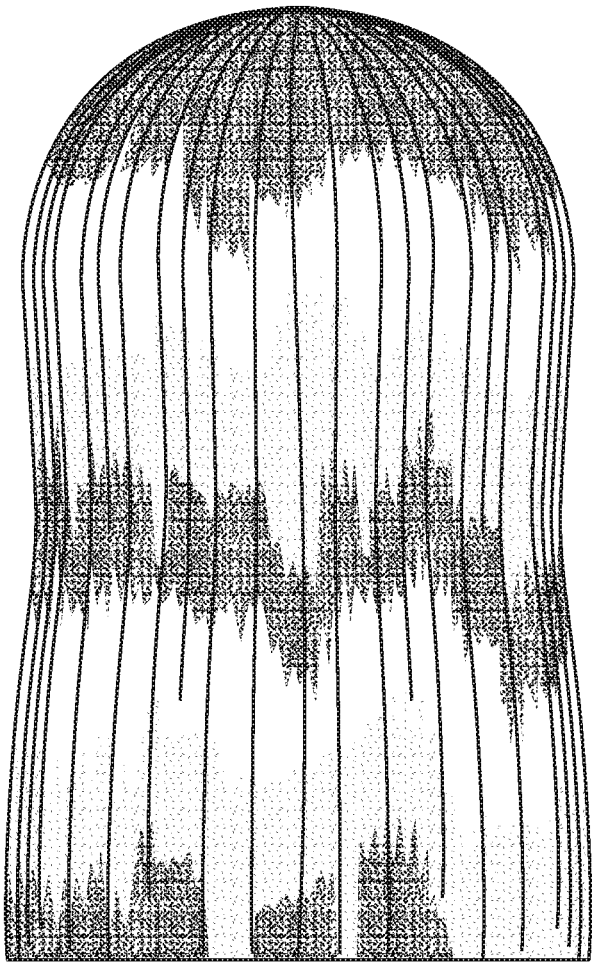
FIG. 9 illustrates an example of hair colored by the methods of FIGS. 2-8.

Once the material 14 has been completely applied, the material 14 is left on the hair for a pre-determined amount of time to allow the material 14 to react and bond with the hair. The material 14 is then removed from the hair, for example, by rinsing with warm and/or hot water and/or shampooing and conditioning, and the hair may be dried or allowed to dry. The hair is then allowed to grow for a period of time, which may be about 4-6 months for medium length or long hair. A shorter period of time (e.g., 3 months) may be allowed for short hair or faster growing hair. Afterwards, the steps for applying the material 14 to the hair are the same steps as described above with regard to FIGS. 3-7, a flow chart of which is shown in FIG. 8. The end result is a unique and aesthetically-pleasing banding effect in the hair, mimicking the hair coating of some animals, as illustrated in FIG. 9.

While this disclosure has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting, the full scope rather being conveyed by the appended claims.

What is claimed is:

1. A method for applying a color-altering material to hair by a user, the method comprising the steps of:

a) selecting an elongated tool having a proximal end and a substantially cylindrical distal end, the cylindrical distal end tapering distally from about ½ inches to about ¼ inches along a length of the elongated tool, the elongated tool comprising a mostly rigid material, the cylindrical distal end enabling even distribution of color-altering material to hair;

b) using the cylindrical distal end of the tool to lift a first slice of the hair adjacent an origination point on a scalp and holding the first slice in a user's hand;

c) dipping a length of the cylindrical distal end of the elongated tool into the color-altering material in order to coat an outer surface of the cylindrical distal end of the elongated tool, a length of the coated cylindrical distal end of the elongated tool being sufficient to alter a color of the first slice of the hair;

d) contacting the coated cylindrical distal end of the elongated tool on an underneath side of the first slice such that a long axis of the cylindrical distal end of the elongated tool is perpendicular to an overall length of the hair, the cylindrical distal end of the elongated tool being spaced apart from the scalp along a length of the first slice;

e) folding the first slice of the hair over the cylindrical distal end of the elongated tool;

f) moving the cylindrical distal end of the elongated tool along the long axis from underneath the first slice of the hair and perpendicular to the overall length of the hair such that at least a portion of the color-altering material is applied to the hair in a direction that is perpendicular to an overall length of the hair from the outer surface of the cylindrical distal end of the elongated tool to the underneath side of the first slice that is spaced apart from the scalp;

g) using the cylindrical distal end of the tool to lift a second slice of the hair adjacent the first slice;

h) repeating steps b) through f) to apply the coloring-altering material to the second slice;

i) allowing the color-altering material to react to and bond with the hair; and j) removing the color-altering material from the hair.

2. The method of claim 1, further comprising the steps of:

k) allowing the hair to grow fora period of time; and l) repeating steps a)-j) to color the hair, such that an area of uncolored hair separates areas of colored hair.

3. The method of claim 2, wherein the period of time is about 3 months to about 6 months.

4. The method of claim 1, further comprising aerating the color-altering material such that a consistency of the color-altering material is similar to whipped cream.

5. The method of claim 1, wherein a depth of the first slice is selected based on properties of the hair.

6. The method of claim 5, wherein the depth of the first slice is between about 1/16 inches and about ¼ inches.

7. The method of claim 1, wherein a depth of the second slice is selected based on the overall length of the hair.

8. The method of claim 7, wherein the depth of the second slice is between about 1/16 inches and about ¼ inches.

9. The method of claim 1, wherein the hair is dry hair.

10. The method of claim 1, further comprising the step of: after step e), pressing the first slice against the cylindrical distal end of the tool to urge the color-altering material through the first slice.

11. The method of claim 1, wherein a depth of the first slice is selected to be translucent.

12. The method of claim 1, wherein the origination point is a natural part of the hair.

13. The method of claim 1, wherein the origination point is a crown of a head.

14. The method of claim 1, wherein the origination point is an occipital bone.

15. The method of claim 1, wherein the origination point is a nape of a neck.

16. The method of claim 1, wherein the color-altering material comprises a developer and a powder, and wherein a ratio of the developer to the powder is about 1:1.3 to about 1:1.8.

17. The method of claim 1, wherein the proximal end of the elongated tool has a curved surface.

18. The method of claim 1, wherein, after step j), a root of the hair adjacent the scalp is uncolored.

* * * * *